United States Patent [19]

Bruce

[11] 4,430,636

[45] Feb. 7, 1984

[54] LOOP DETECTOR FOR TRAFFIC SIGNAL CONTROL

[76] Inventor: Robert L. Bruce, 10513 Medoc Ct., San Diego, Calif. 92131

[21] Appl. No.: 278,766

[22] Filed: Jun. 29, 1981

[51] Int. Cl.[3] ..... G08G 1/07

[52] U.S. Cl. ..... 340/941; 340/933; 324/236; 331/65

[58] Field of Search ..... 331/65; 364/436; 340/31 R, 38 R, 38 L, 551; 324/233, 236; 235/92 TC, 92 TA

[56] References Cited

U.S. PATENT DOCUMENTS 3,474,409 10/1969 Gottlieb ..... 340/38 L
3,599,145 8/1971 Ando et al. ..... 340/38 L

FOREIGN PATENT DOCUMENTS 53-16598 2/1978 Japan ..... 340/38 L
737977 3/1978 U.S.S.R. ..... 340/38 L

OTHER PUBLICATIONS

Ogren, V. G., "Sensor Circuit Utilizing Variable Inductance Input", IBM Technical Disclosure Bulletin, vol. 14, No. 4, p. 1225, Sep. 71.

*Primary Examiner*—Stanley D. Miller
*Assistant Examiner*—W. R. Paxman
*Attorney, Agent, or Firm*—Charmasson & Holz

[57] ABSTRACT

A circuit used in a traffic control apparatus for detecting changes in the frequency of an oscillator which has an inductive loop-sensor as a resonating element. The circuit comprises a phase-locked loop oscillator with restricted tuning range and a high impedance amplifier followed by threshold detectors adjusted to sense the entry and exit of a vehicle over the area covered by the loop-sensor. The high-resolution of the circuit overcomes long-term drift problems inherent to loop-sensor detectors with analog circuitry.

7 Claims, 2 Drawing Figures

LOOP DETECTOR FOR TRAFFIC SIGNAL CONTROL

FIELD OF THE INVENTION

This invention relates to electronic circuits for detecting a change in the freqency of an oscillator. More specifically, this invention relates to loop detectors used in the control of traffic signals. In a typical system, the presence or absence of vehicles near or at an intersection is detected by inductive loops embedded in the pavement. The inductive loop is an integral part of the resonating circuit of an oscillator. The presence or absence of traffic is detected by a change of inductance caused when the metallic mass of the vehicle passes over the loop. In general, the shift in frequency of the oscillator is approximately one-half of the negative of the fractional change of inductance. For instance, a decrease of two percent in the loop inductance causes an increase in frequency of nearly one percent in the oscillator.

BACKGROUND OF THE INVENTION

The major problem associated with the design and operation of loop detectors is due to the fact that the shift of oscillator frequency resulting from the passage of a vehicle over the loop is relatively small in comparison with, for instance, the long term frequency drift which is caused by changes in environmental conditions. Another problem is created by spurious interferences and cross-coupling between adjacent loop-sensors which results in transient frequency shifts. These problems are compounded by the aperiodical nature of the signal which imposes severe restrictions on the time constants of filters which might be used throughout the circuit to compensate for these problems.

Traffic signal controls, however, must be designed with a large margin of reliable operation, must be able to operate in very severe weather conditions and yet require a minimum of periodical maintenance and calibration.

Digital circuits have been used extensively during the last few years in the design of loop detectors in order to palliate the drift problems normally associated with analog circuitry. This preference for digital circuits has in most cases resulted in an increase in the number of necessary components. This, in turn, not only increases the cost of the device but also multiplies the chances of component failures.

SUMMARY OF THE INVENTION

The present invention provides a novel approach to the design and construction of loop detectors for traffic signal control which combine analog circuitry with a few digital components. Circuit reliability and stability is obtained by using a narrow range phase-locked loop oscillator and field effect amplifiers with extremely low input bias current.

The principal object of the invention is to provide a frequency shift loop detector which has relatively high resolution.

Another object of the invention is to provide a loop detector with an efficient long term drift control and rapid recovery rate.

Yet another object of the invention is to provide a loop detector which combines analog and digital circuits in order to reduce the overall number of components while preserving the stability and reliability commonly associated with digital systems.

These and other objects are achieved by the techniques illustrated in the following description of the preferred embodiment of the invention.

DESCRIPTION OF THE PREFERRED EMBODIMENT OF THE INVENTION

The preferred embodiment of the invention is a loop detector that senses the presence of any large metallic body from the small change of inductance of a loop of wire. A common application of this device is in connection with traffic signal control using loops buried in traffic lanes to sense the presence of vehicles.

Figure 1:
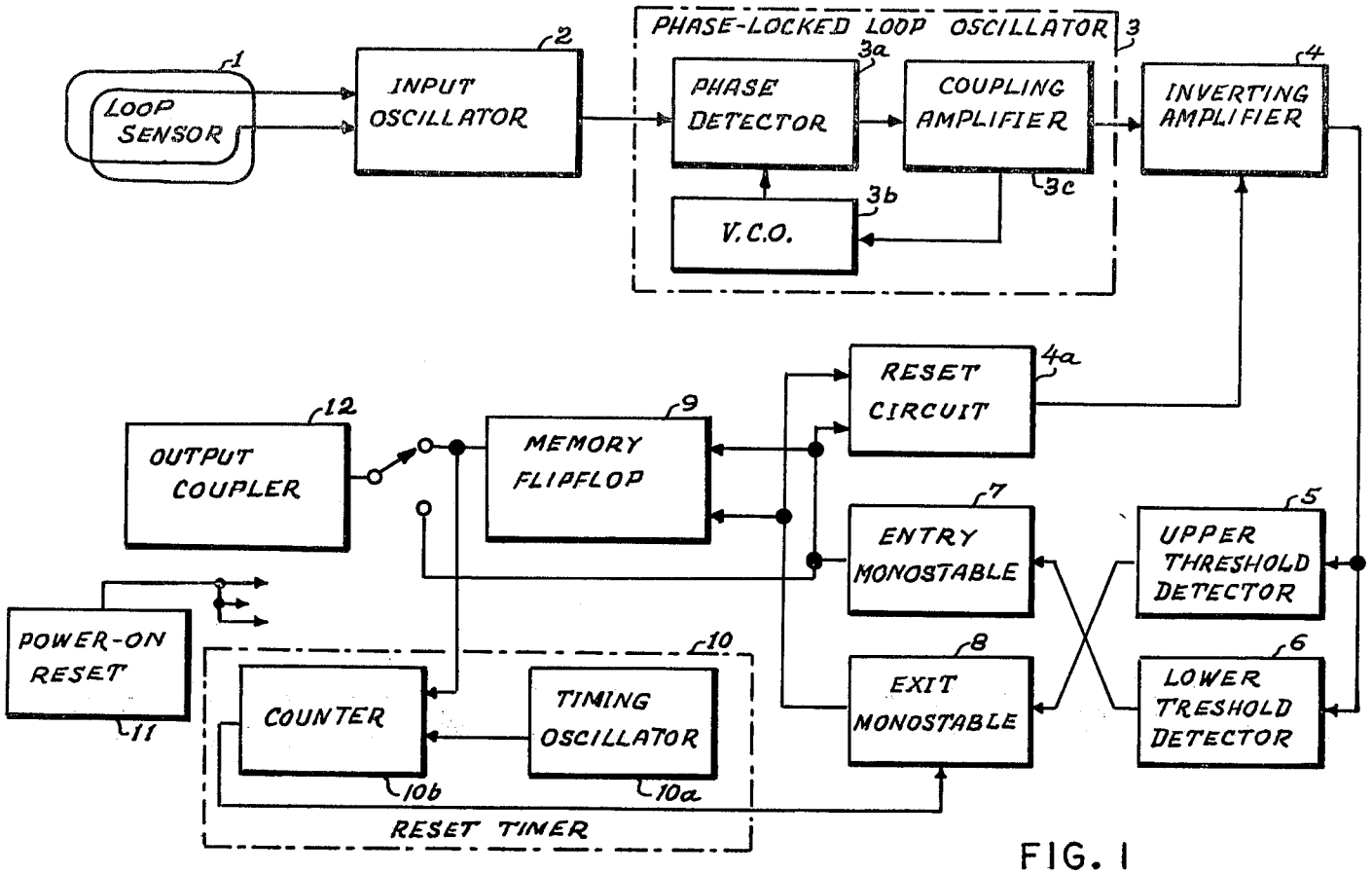
FIG. 1 is the general block diagram of the loop detector.

FIG. 1 is a block diagram showing the major elements of the circuit. These are a sense loop 1, an input oscillator 2, a phase-locked loop oscillator 3, an amplifier 4, a pair of threshold detectors 5 and 6, a pair of monostables 7 and 8, a memory flip-flop 9, a reset timer 10, a power-on reset 11, and an output coupler 12.

The input oscillator 2 is an LC oscillator with the sensor loop 1 in the resonating circuit. As the loop inductance changes, the oscillation frequency changes in a proportional manner. In fact, the fractional change of frequency is very nearly half the negative of the fractional change of inductance. For instance, a decrease of two percent in the loop inductance increases the frequency by nearly one percent. This stage then acts to convert an inductance shift to a frequency shift.

The phase-locked loop oscillator (PLL) 3 comprises a phase detector **3*a*, a voltage-controlled oscillator 3*b* and a coupling amplifier 3*c*. This circuit acts as a demodulator of the signal from the input oscillator. It gives an output voltage that varies in proportion to the frequency of the oscillator. This voltage is capacitor-coupled to the input of a single stage amplifier 4, which in turn drives a pair of threshold detectors 5 and 6. Because the capacitor coupling introduces a long setting time constant, the amplifier is provided with a reset circuit 4*a*** to speed recovery.

The threshold detectors 5 and 6 are voltage comparators whose reference levels are set respectively above and below the quiescent output of the amplifier 4. Each is provided with a small amount of positive feedback to give minimum rise time to their outputs. These outputs drive separate edge-triggered monostable multivibrators 7 and 8. These monostables generate their respective pulses when the signal goes above the upper threshold, or below the lower threshold. The pulses are logically ORed to the amplifier reset circuit **4*a* to "arm" the circuit for the next signal, and separately drive the set and clear inputs of the memory flip-flop 9**.

Normally, a vehicle passing over the loop sensor 1 causes a decrease in loop inductance, an increase of input oscillator frequency, an increase of PLL voltage output, and, since the amplifier inverts, a decrease of input voltage to the threshold detectors. This causes the negative sense monostable 7 (entry) to trigger. The second monostable 8 is referred to as the exit monostable because it triggers when the vehicle leaves. The entry monostable pulse is used to set the memory flip-flop 9, and the exit monostable pulse is used to clear it.

The state of the memory flip-flop then indicates the presence or absence of vehicles in the area of the sensor.

The reset timer 10 comprises a timing oscillator 10*a* and a counter 10*b*. It assures that the memory flip-flop does not stay in the set state for an excessive period of time. When the memory flip-flop is set, the reset timer 10 is enabled to count a continuously running clock 10*a*. When the counter 10*b* reaches an end value, it triggers the exit monostable 8. This clears the memory flip-flop 9 which in turn disables the reset timer 10 and clears its contents.

The power-on reset 11 holds the various circuits in the reset or clear state for a period after power has been applied to allow the circuit voltages to stabilize more quickly. The output coupler 12 has an optical-isolator to reduce stray coupling, and can be selectively driven by the memory flip-flop 9 or the entry monostable pulse.

Figure 2:
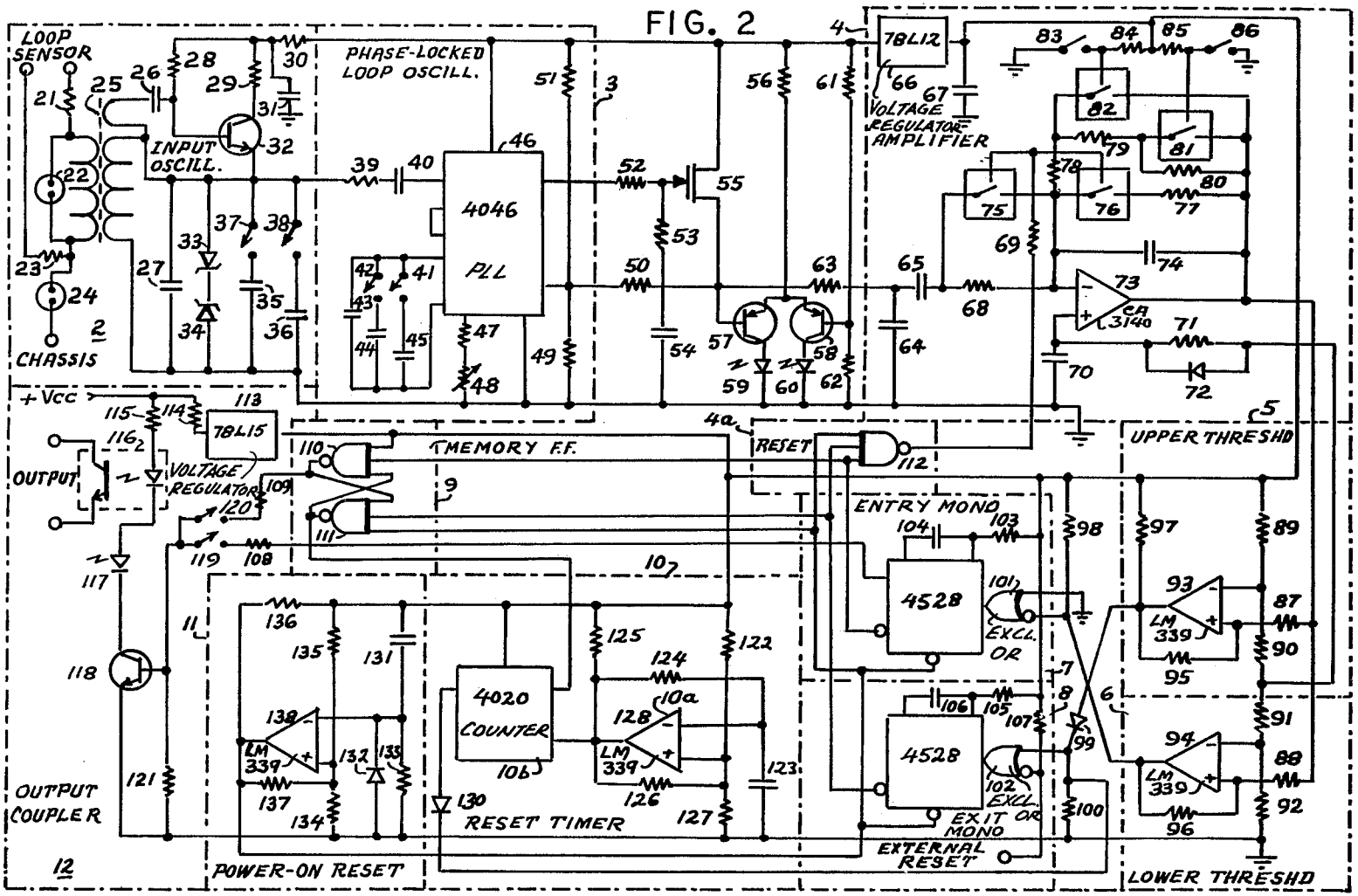
FIG. 2 is its electrical circuit schematic.

Referring now to the schematic of FIG. 2 one can see that the loop sensor 1 is coupled into the oscillator 2 through an RF transformer 25. While this transformer 25 is not essential to the basic function of the detector, it does give improved input isolation from stray signals in the grounding system, and some protection from lightening strikes. The transformer must be designed for high shunt inductance compared to the loop, and low leakage (series) inductance compared to the loop. The transformer also has a small feedback winding for the active element, transistor 32.

On the loop side of the transformer 25 are a pair of neon bulbs 22 and 24 and a pair of resistors 21 and 23 for lightning protection. There also is a pair of avalanche diodes 33 and 34 on the transistor side of the transformer 25 to limit the peak voltage of a strike.

In many installations, several loop detectors will be in operation, and they could interfere with each other if their frequencies are not well separated. To provide for good separation, the oscillator circuit 2 has a pair of capacitors 37 and 38 that can be switched into the resonant circuit to select a suitable frequency.

Capacitor 27 is the main resonating capacitor, and bias for the transistor 32 is from capacitor 26 and resistor 28. Resistor 29 buffers the resonant circuit from the transistor 32, particularly when the transistor is in saturation, and thereby suppresses a multivibrator oscillator mode that could otherwise occur with large input inductances. Capacitor 31 and resistor 30 provide bypassing and isolation. Th oscillator signal is coupled to the PLL 3 through resistor 39 and capacitor 40.

The phase-locked loop oscillator circuit 3 uses a readily available CMOS integrated circuit (4046) for most of the PLL functions, namely, the voltage control oscillator (VCO) 3*b* and the phase detector 3*a*. Manual tuning of the VCO is by variable resistor 48, and switched capacitors 44 and 45. Once tuned, the PLL can track the input frequency over a range of at least plus or minus ten percent. This electrical tuning range is set by the choice of potentiometer ratio in resistors 49, 50, and 51. Restricting the tuning range increase the PLL gain (output volts/input Hz), and thus improves the resolution of the system. The tuning range of the PLL should be adjusted to cover no more than the maximum excursions of the loop sensor oscillator taking into account the long term drift due to environmental conditions and component aging factors. Although the 4046 chip has an internal provision to restrict the tuning range, it is not used because tuning would require either a large variable capacitor or a ganged variable resistor, which would occupy too much space.

Loop compensation is provided by resistors 52 and 53 and by capacitor 54. Transistor 55 (JFET type) gives load isolation, and the circuit including transistors 57 and 58, resistors 61 and 62, and light emitting didodes (LED) 59 and 60 are for tuning indication. Regulator 66 is for power line isolation. High frequency transients from the phase detector 3*a* are filtered by resistor 63 and capacitor 64.

An operational amplifier with field effect transistor inputs (CA3140), 73 is used as an amplifier 4. This type of component has extremely low input bias and offset currents. This permits using very high values of feedback resistor to get high gain without sacrificing temperature stability.

Since the input of the amplifier is capacitor coupled to block slowly changing DC from the PLL, there is a setting time constant determined by capacitor 65 and resistor 68. The time constant must be chosen long enough to give negligible loss of the desired signal without requiring excessive component values but not so long that circuit drift comes through. Increasing the value of resistor 68 gives a longer time constant but requires a larger feedback resistor (78, 79, 80) to keep the same gain. Increasing capacitor 65 gives a longer time constant and does not reduce gain, but will probably require more physical space. Thus there is a tradeoff relation among detector sensitivity, temperature stability, and physical size. The FET input operational amplifier, however, having a very high input impedance allows the use of a very high series input resistor 68. This resistor and the amplifier feedback loop are shunted momentarily by the reset circuit 4*a* after each entry or exit signal detection.

Selectable gain is provided by the bilateral switches 81 and 82 that reduce the feedback resistance. The scheme of remote switching shown reduces stray coupling. Bilateral switches 75 and 76 with resistor 77 form the reset circuit 4*a* and are activated through resistor 69 to severly reduce the settling time for initializing the circuit. Capacitor 74 reduces high frequency noise, maintaining constant gain-bandwidth product as the gain is changed. The reference voltage for the operational amplifier is decoupled by resistor 71 and capacitor 70 and comes from a divider formed by resistors 89, 90, 91, and 92, which also provides the reference voltages to the threshold detectors in the next stage. Diode 72 speeds initialization at power up.

The threshold detectors are voltage comparators 93 and 94 (LM339). They have some positive feedback through resistors 95 and 96, respectively to decrease output transition time, and are referenced to the signal with the previously mentioned divider network 89, 90, 91 and 92. Resistors 97 and 98 are load resistors for the open collector outputs of the LM339 comparators.

Normally the output of the operational amplifier 4 drops with vehicle presence (negative sense), and this is detected by comparator 94 which is referenced at the lower voltage. The output of this comparator is a falling edge (inverted logic). The other comparator 93 is referenced to the upper voltage and detects vehicle exit with a rising edge (positive logic). These outputs go respectively to the entry and exit monostables 7 and 8.

A CMOS dual monostable (4528) is used for the entry and exit monostables 7 and 8. These have two inputs for positive or negative edge triggering. The entry monostable 101 is wired for negative edge triggering from the output of the lower comparator 94. The exit monostable has inputs from the upper comparator 93, the reset timer 10, and the external reset input. The comparator and counter signals are in the positive sense and are ORed together through diodes 99 and 130, with pulldown resistor 100, to the positive edge trigger input of the exit monostable. The external reset is tied to the other input for negative edge resetting.

The timing components for the monostables are resistors 103 and 105, and capacitors 104 and 106. They are chosen for the desired pulse length. The output pulses from the two monostables are ORed together with gate 112 to reset the amplifier 4 through resistor 69. This rapidly stabilizes the amplifier for the next signal. The gate also has an input from the power-on reset circuit 11.

The memory flip-flop 9 is formed by a pair of cross coupled NAND gates 110 and 111. The output of the entry monostable sets the flip-flop (output of 110 high), and the output of the exit monostable clears it. When set, showing vehicle presence, the output of gate 111 goes low and is connected to the reset timer counter 129 to enable it. There is also an extra input to gate 111 for clearing the flip-flop 9 from the power-on reset circuit 11.

The output circuit 12 has an optical-coupler 116 in order to isolate the output signals from local circuits. It is driven by transistor 118 through LED 117 for local indication, and load resistor 115. Either the flip-flop output from NAND gate 110 or the entry monostable pulse may be selected by switches 119 or 120.

One section of the quad comparator LM339 is used as the timing oscillator 10*a*. Its period is set by resistor 124 and capacitor 123. The needed positive feedback is through resistor 126. Counter 129 is used to set a long timeout period without using very large values of resistor 124 or capacitor 123. The counter 10*b* also provides a convenient way to start and end the timeout period using its clear/disable input, which is tied back to the flip-flop memory 9.

The power-on reset circuit 11 uses the last section of the LM339. When power comes on, the voltage on the negative input off the comparator 138 goes high because of capacitor 131. The output of the comparator consequently goes low generating a negative logic reset. This reset is distributed to both of the monostables 7 and 8, the output flip-flop 9, and the amplifier 4. As capacitor 131 charges through resistor 133, the voltage falls, eventually reaching the reference voltage on the positive input of the comparator 138. At this point, the output of the comparator switches to terminate the reset pulse.

Power for the detector is regulated by regulator 113 with resistor 114 absorbing some of the excess input voltage and capacitor 67 bypassing current transients.

While the preferred embodiment of the invention has been described, it should be understood that modifications can be made thereto and other embodiments may be devised without departing from the spirit of the invention and the scope of the appended claims.

What is claimed is:

1. A traffic signal control apparatus, for detecting changes in the frequency of a loop-sensor oscillator, comprising a phase-locked loop including a voltage-controlled oscillator and a phase detector generating an output voltage proportional to the phase difference between the output of the loop-sensor oscillator and the output of the voltage-controlled oscillator, and which further comprises: an attenuating and phase compensation network coupling the output of the phase detector to the control voltage input of the voltage-controlled oscillator, said network being adjusted to severely restrict the tuning range of the voltage-controlled oscillator to cover no more than the maximum expected frequency change excursions of the loop-sensor oscillator in order to obtain the maximum output voltage from the phase-locked loop for a given phase difference between the output of the loop-sensor oscillator and the output of the voltage-controlled oscillator.

2. The apparatus claimed in claim 1 which further comprises; a low input-bias-current amplifier capacitively coupled to the attenuating and phase compensation network; said amplifier having low input and bias offset current, a high impedance feedback loop, a low impedance shunt switchable across the feedback loop, and means for temporarily switching said shut across said feedback loop upon detection of a sudden change in the frequency of the loop-sensor oscillator, said shunt being selected to shorten the recovery time of said amplifier by quickly discharging its input coupling capacitor.

3. The apparatus claimed in claim 2 which further comprises:

at least one threshold detector connected to the output of the amplifier;

said at least one threshold detector being adjusted to generate a triggering signal upon a sudden shift of the loop-sensor oscillator frequency.

4. A traffic signal control apparatus for detecting changes in the frequency of a loop-sensor oscillator, comprising a phase-locked loop including a voltage-controlled oscillator and a phase detector generating an output voltage proportional to the phase difference between the output of the loop-sensor oscillator and the output of the voltage-controlled oscillator, and which further comprises:

an attenuating network coupling the output of the phase detector to the contol voltage input of the voltage-controlled oscillator;

an amplifier coupled to the attenuating network;

at least two threshold detectors connected to the output of the amplifier;

one of said detectors being adjusted to generate an entry triggering signal whenever the frequency shift of the loop-sensor oscillator corresponds to a sudden increase in the loop sensor inductance;

another of said detectors being adjusted to generate a exit triggering signal whenever the frequency shift of the loop sensor oscillator corresponds to a sudden decrease of the loop-sensor inductance.

5. The apparatus claimed in claim 4 which further comprises:

a capacitor coupling network and a high series input resistor connected between the output of the phase-detector and the amplifier; and means for switching a low impedance shunt across said series input resistor in response to either one of said entry and exit triggering signals.

6. The apparatus claimed in claim 4 which further comprises:

a memory means, for indicating whether the last change in the frequency of the loop-sensor oscillator was positive or negative, said memory means having a set-input connected to said entry triggering signal and a clear-input connected to said exit triggering signal.

7. The apparatus claimed in claim 6 which further comprises:

a reset timer responsive to said entry triggering signal;

said reset timer being adjusted to clear the memory means after a desireable period of time.

* * * * *